US012667179B2

(12) United States Patent
Li

(10) Patent No.: US 12,667,179 B2
(45) Date of Patent: Jun. 30, 2026

(54) DISPENSING ASSEMBLY AND CONTAINER SYSTEM INCLUDING THE SAME

(71) Applicant: SILGAN DISPENSING SYSTEMS (WUXI) CO. LTD., Richmond, VA (US)

(72) Inventor: Zhigang Li, Wuxi (CN)

(73) Assignee: Silgan Dispensing Systems (Wuxi) Co. Ltd., Wuxi (CN)

( * ) Notice: Subject to any disclaimer, the term of this patent is extended or adjusted under 35 U.S.C. 154(b) by 100 days.

(21) Appl. No.: 18/845,238

(22) PCT Filed: Mar. 24, 2023

(86) PCT No.: PCT/CN2023/083673
§ 371 (c)(1),
(2) Date: Sep. 9, 2024

(87) PCT Pub. No.: WO2023/185676
PCT Pub. Date: Oct. 5, 2023

(65) Prior Publication Data

US 2025/0185782 A1 Jun. 12, 2025

(30) Foreign Application Priority Data

Mar. 31, 2022 (CN) ..... 202210331937.1

(51) Int. Cl.
*A45D 34/04* (2006.01)
*B65D 47/18* (2006.01)

(52) U.S. Cl.
CPC ..... *A45D 34/04* (2013.01); *B65D 47/18* (2013.01); *A45D 2200/055* (2013.01)

(58) Field of Classification Search
CPC .. A45D 34/04; A45D 2200/055; B65D 47/18; B01L 3/0272
See application file for complete search history.

(56) References Cited

U.S. PATENT DOCUMENTS

2011/0284123 A1* 11/2011 Bouix ..... G01F 11/025 222/113
2021/0251366 A1* 8/2021 Zhong ..... A45D 34/04

FOREIGN PATENT DOCUMENTS

EP 3778418 A1 * 2/2021 ..... G01F 11/025
KR 102354313 B1 1/2020
(Continued)

*Primary Examiner* — Jeremy Carroll
(74) *Attorney, Agent, or Firm* — Hinckley Allen & Snyder; Stephen Holmes

(57) ABSTRACT

The present invention relates to a dispensing assembly and a container system including the same. The dispensing assembly comprises: a first chamber of a first volume provided with a first opening sealed by a first valve; a second chamber of a second volume provided with a second opening sealed by the first valve, when the first valve leaves the second opening, the first chamber is in fluid communication with the second chamber, a second valve is provided in the second chamber, when the second valve is open, a second fluid can enter the second chamber; a primary piston slidable along a sidewall of the first chamber and defines the second chamber; a secondary piston located in the second chamber and slidable along a sidewall of the second chamber; and a movable piston rod which can actuate the secondary piston; when the first valve leaves the first opening, the second valve is closed as the piston rod actuates the secondary piston to slide downward, and the pressure of the second fluid in the second chamber forces the first valve to leave the second opening, so that the second fluid in the second chamber enters the first chamber, allowing the first fluid of the second volume to be discharged out from the first chamber.

17 Claims, 19 Drawing Sheets

(56) References Cited

FOREIGN PATENT DOCUMENTS

| | | | | | |
|---|---|---|---|---|---|
| WO | WO-2012136938 | A1 * | 10/2012 | ..... | A45D 34/04 |
| WO | 2022108137 | A1 | 5/2022 | | |

* cited by examiner

DISPENSING ASSEMBLY AND CONTAINER SYSTEM INCLUDING THE SAME

TECHNICAL FIELD

The present invention generally relates to a dispensing assembly and a container system including the same. More specifically, a dropper-type dispensing assembly is usually removably attached to the container so that the user can draw and dispense the product from the container through the dropper for use, e.g., a dropper-style cosmetic container.

BACKGROUND

Nowadays, many products using a dropper-type container, such as essential oils, eye creams, serums, liquid foundations, medicines, and other products, is drawn from the container through a dropper and then is dispensed to the desired location. Such products can be expensive and used only in a small quantity at a time. However, existing dropper bottle caps usually include a rubber head which the user squeezes to expel air and releases to suck the product in the bottle into the dropper. Then the dropper is removed out from the bottle, and the rubber head is squeezed again to discharge the drawn product out of the dropper.

During such suction and dispense processes, the user usually cannot accurately control the sucked and expelled doses. On the one hand, if the amount sucked at a time is less than the required amount, the user needs to re-insert the dropper into the bottle to repeat the operation. Such repetitive operations are very cumbersome for the user, and the operation of moving the dropper in and out of the bottle multiple times may cause contamination of the product in the bottle. On the other hand, if the amount sucked at a time is greater than the required amount, there is no way for the user to prevent expelling the excess dose. In addition, if the user inadvertently releases the rubber head slightly during use, the product would be expelled suddenly at an undesired location, resulting in product waste and a poor customer experience. Therefore, with existing dropper assemblies, the user cannot control the desired product amount, which can lead to cumbersome operations or waste of the product.

For applications that require small and multiple doses of the product in determined quantities, such dropper assemblies cannot meet the user's demands, either. For example, when an exact dose of product needs to be applied at different locations, with the existing droppers, the product must be re-drawn after it is discharged out, and then the dropper is transferred to the desired location to dispense the product. Further, with the dropper-type dispensing assemblies in the prior art, the user cannot control the amount dispensed each time, nor can he or she can ensure that the dispensed amount is the same each time. Moreover, the product is prone to leak out to an undesired location during the transfer of the dropper.

SUMMARY OF THE INVENTION

The present invention aims to solve the problems in the prior art as mentioned above, and to provide a dispensing assembly that allows the user to control the expelled amount, as well as a container system including such a dispensing assembly. The dispensing assembly according to the present invention allows sucking the fluid from the container once, and then the fluid can be distributed at least twice or several times in exact doses.

One aspect of the present invention relates to a dispensing assembly for dispensing a first fluid, comprising:

- a first chamber of a first volume, of which the bottom is provided with a first opening sealed by a first valve, wherein when the first valve leaves the first opening, the first fluid is allowed to enter or leave the first chamber;
- a second chamber of a second volume, of which the bottom is provided with a second opening sealed by the first valve, when the first valve leaves the second opening, the first chamber is in fluid communication with the second chamber, the second chamber further comprises internally a second valve, when the second valve is open, a second fluid can enter the second chamber, wherein the second volume is less than the first volume;
- a primary piston slidable along a sidewall of the first chamber and defines internally the second chamber;
- a secondary piston located in the second chamber and slidable along a sidewall of the second chamber;
- a movable piston rod, its lower end is located in the second chamber and can actuate the secondary piston to slide along the sidewall of the second chamber;
- wherein when the first valve leaves the first opening, the second valve is closed as the piston rod actuates the secondary piston to slide downward, and the pressure of the second fluid in the second chamber forces the first valve to leave the second opening such that the second fluid in the second chamber enters the first chamber, thereby allowing the first fluid of a volume corresponding to the second volume to be dispensed out from the first chamber.

By means of the dispensing assembly in the present invention, the first fluid of a first volume in the first chamber may be discharged at multiple times, and the first fluid of the second volume may be discharged at one time, whereby the user may dispense the product with the dispensing assembly more flexibly and more conveniently.

In an embodiment of the present invention, the dispensing assembly further comprises:

- a movable cam seat closely engaged with an upper end of the primary piston so as to actuate the primary piston to slide along the sidewall of the first chamber, the cam seat including an upper position and a lower position,
- a rotary ring located outside the cam seat, which actuates the cam seat when being rotated,
- a shroud located outside the rotary ring, which fits closely with the rotary ring so as to actuate the rotary ring to rotate with it when being rotated,
- wherein when the user rotates the shroud in a first direction to bring the dispensing assembly into a dispensing state, the rotation of the shroud and the rotary ring causes the cam seat to move towards the upper position, and at the same time causes the primary piston to slide upwards, such that the first valve engaged with the primary piston leaves the first opening, allowing the first fluid of the first volume to enter the first chamber through the first opening; and
- when the user rotates the shroud in a second direction opposite to the first direction, the cam seat, the primary piston and the first valve return downward to their lower positions, and the dispensing assembly returns to a storage state.

By means of the dispensing assembly in the present invention, when the container is opened, the first fluid of the first volume can be automatically sucked into the first chamber. That is, the first fluid of the first volume can be automatically loaded into the first chamber without additional drawing operation by the user.

In an embodiment of the present invention, the cam seat is provided with at least one protrusion on the outer side, and the rotary ring is provided with at least one guide track for guiding the at least one protrusion, wherein when the cam seat is located in the lower position, the at least one protrusion is in a first horizontal position in the guide track;

when the cam seat is in the upper position, the at least one protrusion is in a second horizontal position in the guide track, and the height of the first horizontal position is different from that of the second horizontal position.

In an embodiment of the present invention, the dispensing assembly further comprises an elastic element for restoring the piston rod to its position, which is supported between the piston rod and the cam seat, wherein the piston rod comprises an inclined upper guiding surface at its upper end for guiding an upper end of the elastic element, the cam seat comprises an inclined lower guiding surface at its upper end for guiding a lower end of the elastic element.

In an embodiment of the present invention, the dispensing assembly further comprises a top cover having a rest position and a depressible position which is closely engaged with the top end of the piston rod, wherein when the user depresses the top cover in the depressible position, the top cover actuates the piston rod, causing the elastic element to deform, the piston rod and the secondary piston then reach the bottom position in the second chamber, and at the same time the first valve is forced to leave the second opening, so as to dispense a first fluid of the second volume from the dispensing assembly; and when the user releases the top cover, due to the restoring force provided by the elastic element, the piston rod and the secondary piston return to their top position in the second chamber, and the top cover returns to the depressible position and is ready for another dispense.

In an embodiment of the present invention, the second valve is formed by the secondary piston and the lower end of the piston rod, wherein the secondary piston includes on the inner side an upward expanding section and a downward expanding section;

wherein the piston rod comprises a first diameter segment and a second diameter segment, a lower flange is provided at a lower end of the second diameter segment, the lower flange extends around a portion of the perimeter of the piston rod and sets aside an axial channel allowing the second fluid to pass through;

wherein when the downward expanding section of the secondary piston abuts against the lower flange of the piston rod, the second valve opens, and the second fluid enters the second chamber through the axial channel;

when the upward expanding section of the secondary piston abuts against the first diameter segment of the piston rod, the second valve is closed to prevent the second fluid from entering the second chamber.

In an embodiment of the present invention, the secondary piston further comprises on its inner side an intermediate section connecting the upward expanding section with the downward expanding section, the outer diameter of the first diameter segment is greater than the minimum inner diameter of the upward expanding section, the outer diameter of the second diameter segment is slightly less than the inner diameter of the intermediate section, and the maximum outer diameter of the lower flange is greater than the minimum inner diameter of the downward expanding section.

In an embodiment of the present invention, the cam seat further comprises a first inclined mating surface on the inner side of the upper end, the piston rod comprises a second mating surface on the outer side, the first and the second mating surfaces cooperate to guide the movement of the piston rod, and to reduce the force needed for depressing the top cover; and/or the cam seat includes circumferential spaced-apart ribs on the inner side of the upper end.

In an embodiment of the present invention, the first volume is n times the second volume, wherein n is an integer, the dispensing assembly is configured to allow dispensing the first fluid of the first volume by n presses, wherein each press allows dispensing the first fluid of a volume corresponding to the second volume.

In an embodiment of the present invention, the primary piston comprises at its bottom a valve-passing-opening for allowing at least a portion of the first valve to be inserted and held therein, and the first valve is able to move slightly in the valve-passing-opening without leaving the primary piston;

wherein the second opening is at least one through-hole provided at the bottom of the primary piston.

In an embodiment of the present invention, the piston rod comprises a recess inside the second diameter segment, which allows to accommodate at least a portion of the first valve.

In an embodiment of the present invention, the dispensing assembly further comprises a closure which defines internally the first chamber and comprises the first opening at its bottom.

In an embodiment of the present invention, the first fluid is the product to be dispensed, and the second fluid is air.

In an embodiment of the present invention, the first valve is a disc valve.

In an embodiment of the present invention, the dispensing assembly further comprises a gasket on top of the closure and a pipette connected within the closure, the pipette being in fluid commutation with the first opening.

In an embodiment of the present invention, the elastic element may include a stiffener, in particular in the intermediate portion connecting the two leg portions.

In another aspect of the present invention, it also relates to a container system comprising:

the dispensing assembly described above; and a container which defines a storage chamber for containing the first fluid and to which the dispensing assembly is removably connected, the pipette of the dispensing assembly extending into the container.

A container system of such configuration allows the user to accurately control the expelled dose, whereby the operation of the user is greatly improved, product waste being avoided, and contamination of the product inside the container also being avoided as much as possible. Further, by means of the container system in the present invention, it is possible to automatically draw the fluid from the container only once, and then dispense the fluid in a specified quantity for at least two or more times. Thus, the container system according to the present invention allows the user to transfer the dispensing assembly to another position and then dispense another precise dose after dispensing a precise dose once, without having to repeatedly draw the product from the container.

Other forms, objects, features, aspects, advantages, and other embodiments of the present invention will be apparent from the detailed description and drawings provided herein.

BRIEF DESCRIPTION OF THE DRAWINGS

The disclosure of the present invention will be more apparent with reference to the figures. It should be understood that these figures are only for exemplary and illustrative purposes, and are not intended to limit the protection scope of the present invention. In the figures.

FIG. 5*a*-FIG. 5*c* schematically illustrate the operation of the dispensing assembly according to the present invention, in which FIG. 5*a* shows the storage state of the dispensing assembly, FIG. 5*b* shows the dispensing assembly in the dispensing state, and FIG. 5*c* shows the dispensing assembly when one dispense is performed.

DETAILED DESCRIPTION OF THE INVENTION

In the figures, the same reference signs refer to the same or functionally equivalent elements, unless otherwise specified. The elements shown in the figures are not all drawn to scale, but are intended to clearly illustrate the principles of the invention.

Figure 1:
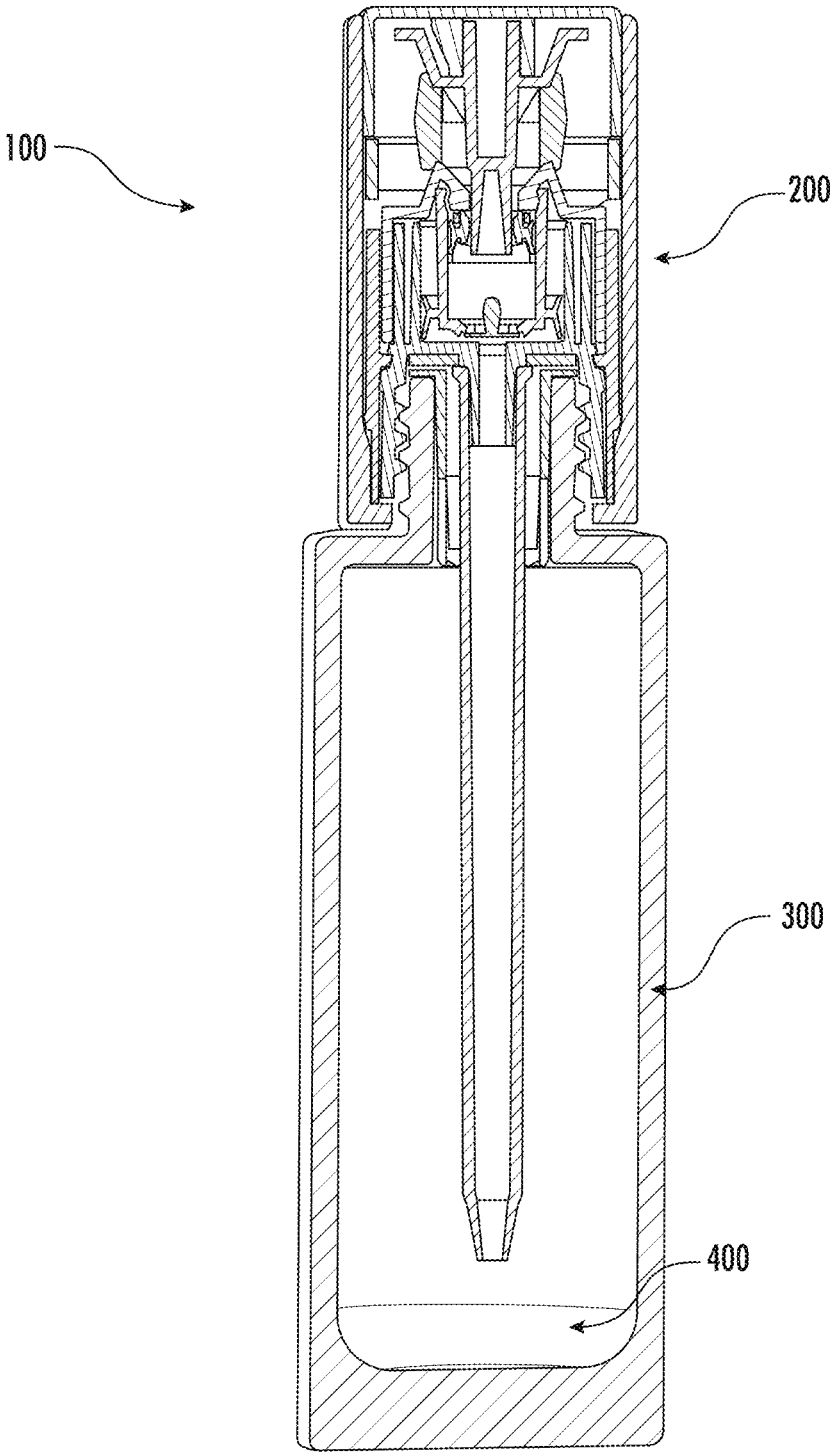
FIG. 1 is a schematic view of a container system according to the present application.

FIG. 1 shows generally a schematic cross-sectional view of a container system 100 according to the present invention, comprising a dispensing assembly 200 and a container 300. A first fluid 400, such as liquids, viscous flowable materials, foams, gels, pastes, and the like, can be stored in the container 300. The first fluid may be any product that is suitable for dispensing, including but not limited to essential oils, eye creams, serums, liquid foundations, medicines, etc.

The container 300 includes a container opening at the top, through which the pipette of the dispensing assembly 200 can be moved into and/or out of the container. After insertion of the pipette of the dispensing assembly into the container, the dispensing assembly 200 can be hermetically engaged with the top of the container to ensure the sealing of the container, in any suitable manner such as by threaded engagement or form fit.

The container system 100 as a whole may be made of plastic material, so that all the components of the entire container system are recyclable, such as polypropylene (PP) and high density polyethylene (HDPE). The container 300 may be in the form of a bottle or a can, but is not limited thereto. Similarly, in the embodiment shown, the container 300 and/or other components may have a generally cylindrical shape. But it should be understood that different shapes are possible in other variations.

Figure 2:
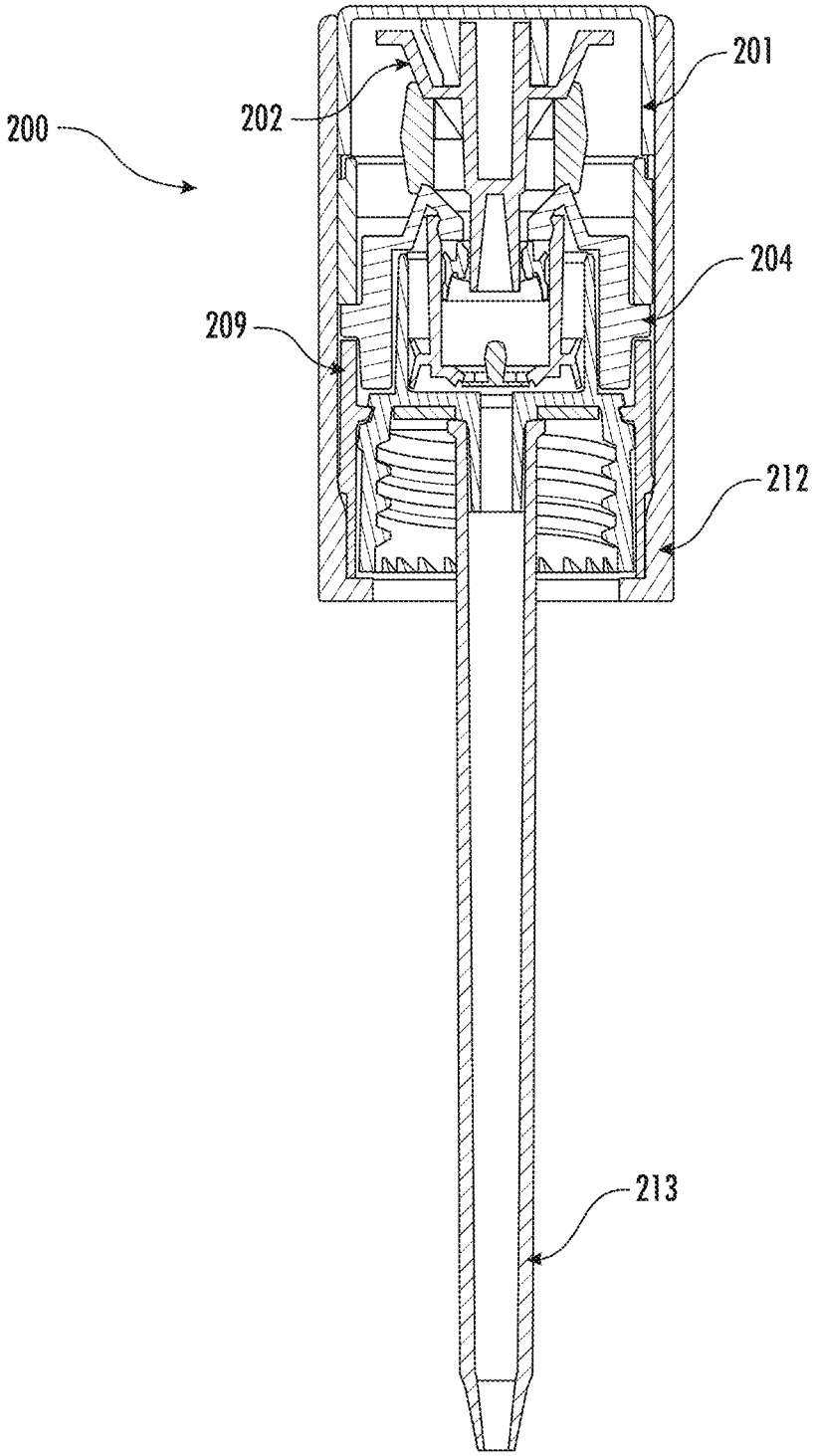
FIG. 2 is a schematic view of a dispensing assembly according to the present invention.
Figure 3:
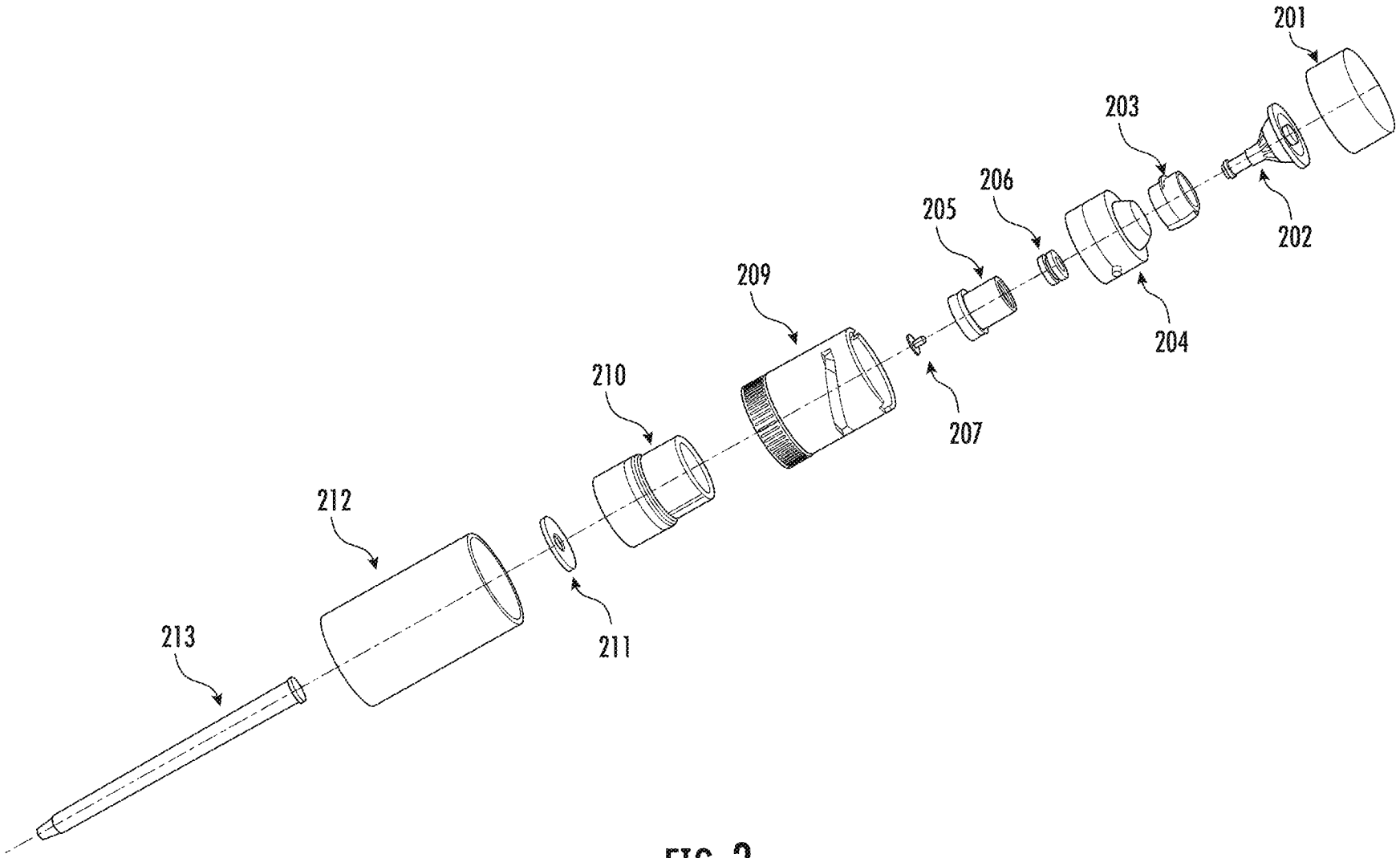
FIG. 3 is an exploded schematic view of a dispensing assembly according to the present application.

FIG. 2 generally shows a dispensing assembly 200 according to the present invention, and FIG. 3 shows an exploded schematic view of the dispensing assembly 200 along a longitudinal axis. The dispensing assembly 200 includes a pipette 213 at the lower end, which may extend into the opening of the container for drawing the first fluid. The dispensing assembly 200 includes a top cover 201 at the top end. When the dispensing assembly 200 in a storage state is located in the container 300, the top cover 201 is in a rest position as a part of the outer cover of the container; while the dispensing assembly is rotated for opening the container, the top cover 201 moves to a depressible position. At this time, the top cover can be used as a push button for controlling the dispensing of the first fluid from the dispensing assembly. A shroud 212 is located outside of the top cover 201, and forms an outer cover that may cover the container together with the top cover 201. When the product needs to be dispensed, by rotating the shroud 212 in a first direction, the user may open the container. While opening the container, the top cover 201 reaches the depressible position. By rotating the shroud 212 in a second direction opposite to the first direction, the top cover 201 can be returned to the rest position.

Inside the shroud 212 and below the top cover 201, a substantially cylindrical rotatory ring 209 is provided, which fits closely with the shroud 212, such that the rotation of the shroud can cause the rotary ring to rotate along with the shroud. For example, the shroud 212 may be form-fit with the rotary ring. In an embodiment, a recess may be provided on the inner side of the shroud 212, for accommodating a protrusion provided on the outer side of the rotary ring 209. In another embodiment, a recess may be provided on the outer side of the rotary ring 209, and a protrusion that matches with the recess is provided on the inner side of the shroud 212.

Inside the rotary ring 209, a cam seat 204 is provided, which is movable between an upper position and a lower position. When the dispensing assembly is in the storage state, the top cover 201 is in the rest position, and the cam seat 204 is located in the lower position; when the dispensing assembly is switched to the dispensing state, the top cover 201 moves to the depressible position, and the cam seat 204 moves to the upper position. The rotary ring 209 may cooperate with the cam seat 204 to convert the rotational motion of the rotary ring 209 into a linear motion of the cam seat 204 between the lower and the upper positions.

Referring to FIG. 2 and FIG. 3, the dispensing assembly 200 includes a movable piston rod 202 inside and below the top cover 201. The piston rod 202 is securely connected to the top cover 201 and may move linearly together with the top cover. When the top cover 201 is depressed, the piston rod 202 moves down vertically, and when the top cover 201 is released, the piston rod 202 returns to its previous position along with it. The outer side of the piston rod 202 may also be in contact with a portion of the inner side of the cam seat 204.

Figure 4:
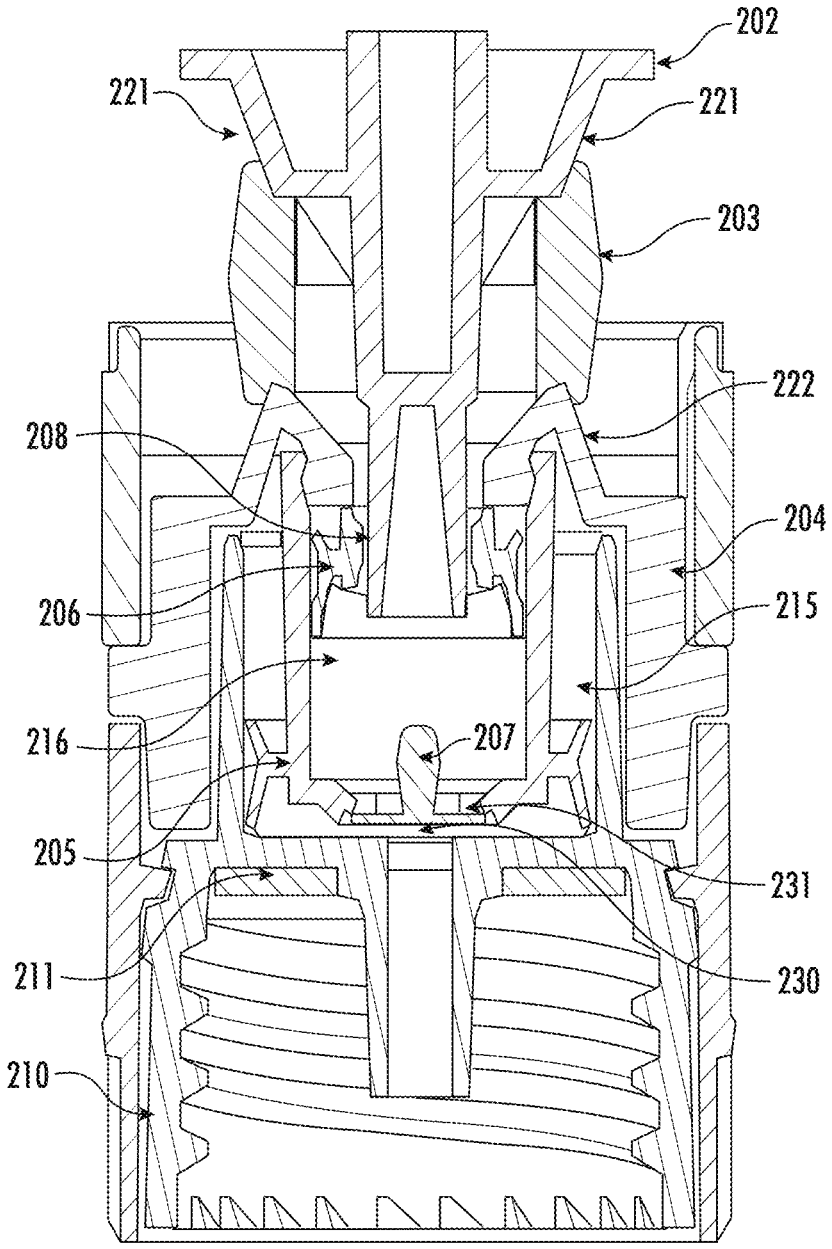
FIG. 4 is a schematic view of a portion of a dispensing assembly according to the present application.

FIG. 4 more clearly illustrates a portion of the dispensing assembly 200, wherein the top cover 201, the shroud 212 and the pipette 213 are removed for the purpose of clear illustration. Referring to FIG. 4, the dispensing assembly 200 further includes a deformable elastic element 203 extending around at least a portion of the intermediate portion of the piston rod 202. The upper end of the elastic element 203 abuts against the piston rod 202, and the lower end abuts against the cam seat 204. The piston rod 202 may include an inclined upper guiding surface 221, such that the elastic element 203 can move along this upper guiding surface 221. The cam seat 204 may include an inclined lower guiding surface 222, such that the elastic element 203 can move along this lower guiding surface 222. When the top cover 201 is in the rest position, the elastic element 203 is in the initial state. When the top cover 201 is in the depressible position, depressing the top cover 201, the force in the vertical direction is applied to the elastic element 203 via the piston rod 202, so that the elastic element is deformed and moves along the upper guiding surface 221 and the lower guiding surface 222. When the top cover is released, the elastic element 203 returns to the initial state, and thereby acts on the upper and the lower guiding surfaces. The restoring force provided by the spring element 203 results in that the top cover 201 and the piston rod 202 also return to their previous positions.

A closure 210 for tight connection to the top of the container is provided inside and below the cam seat 204. The lower portion of the closure 210 is intended to be connected to the top end of the container, and its upper portion is located inside the cam seat 204. In an embodiment, the closure 210 may include a gasket 211 inside to ensure a hermetic seal at the engaged portion when it engages with the container. The closure 210 internally defines a first chamber 215 of a first volume V1 of which the bottom is provided with a first opening 230 sealed by a first valve 207. When the first valve 207 leaves the first opening 230, the first chamber 215 may be in fluid communication with the container via the pipette 213, allowing for the first fluid of a first volume V1 to be drawn from the container. When the first valve 207 leaves the first opening 230, the first fluid is also allowed to be discharged from the first chamber through the pipette.

The primary piston 205 is located in the first chamber 215, and may slide along its sidewall. The upper end of the primary piston 205 is tightly engaged with the top end of the cam seat 204, such that the cam seat 204 may actuate the primary piston 205 to move upward vertically. In an embodiment, the upper end of the cam seat 204 may be form-fit with the upper end of the primary piston 205. The bottom of the primary piston 205 may be engaged with the first valve 207 such that the first valve 207 can be actuated to leave the first opening. The primary piston 205 may include a valve-passing-opening 214 at the bottom, such that at least a portion of the first valve 207 can be inserted into the valve-passing-opening 214 and held therein. When the primary piston 205 moves up with the cam seat, the first valve 207 also moves up with the primary piston and leaves the first opening 230, thereby allowing the first fluid of a first volume V1 in the container to enter the first chamber.

The primary piston 205 further defines internally a second chamber 216 of a second volume V2, wherein the second volume V2 is less than the first volume V1. The second opening 231 at the bottom of the second chamber 216 is also sealed by the first valve 207. When the first valve 207 leaves the second opening 231, the first chamber is in fluid communication with the second chamber. The second opening 231 may be at least one through-hole provided at the bottom of the primary piston 205. Preferably, a plurality of evenly distributed through-holes is provided at the bottom of the primary piston 205.

The second chamber 216 further includes a second valve 208 inside.

When the second valve 208 is opened, the second fluid 500 corresponding to the second volume V2 may enter the second chamber. When the second valve is closed, the second fluid is prevented from entering the second chamber. In a preferred embodiment, the second fluid 500 may be air.

The second chamber 216 also has a secondary piston 206 inside, which is slidable along the sidewall of the second chamber 216. The secondary piston 206 cooperates with the piston rod 202, such that the piston rod 202 may actuate the secondary piston 206 to move vertically in the second chamber. When the top cover is in the depressible position, the piston rod 202 and the secondary piston are at the top position in the second chamber. When the top cover 201 is depressed and the piston rod 202 actuates the secondary piston 206 to move downward vertically, the second valve 208 is closed. At this time, the pressure of the second fluid in the second chamber 216 forces the first valve 207 to leave the second opening 231, so that almost all the second fluid 500 in the second chamber enters the first chamber 215, thereby forcing the first fluid in the first chamber to be discharged. When the secondary piston 206 reaches the bottom position in the second chamber 216, almost all the second fluid 500 in the second chamber enters the first chamber, so that the first fluid of a volume corresponding to the second volume V2 is discharged from the first chamber.

Figures 5A, 5B, 5C:
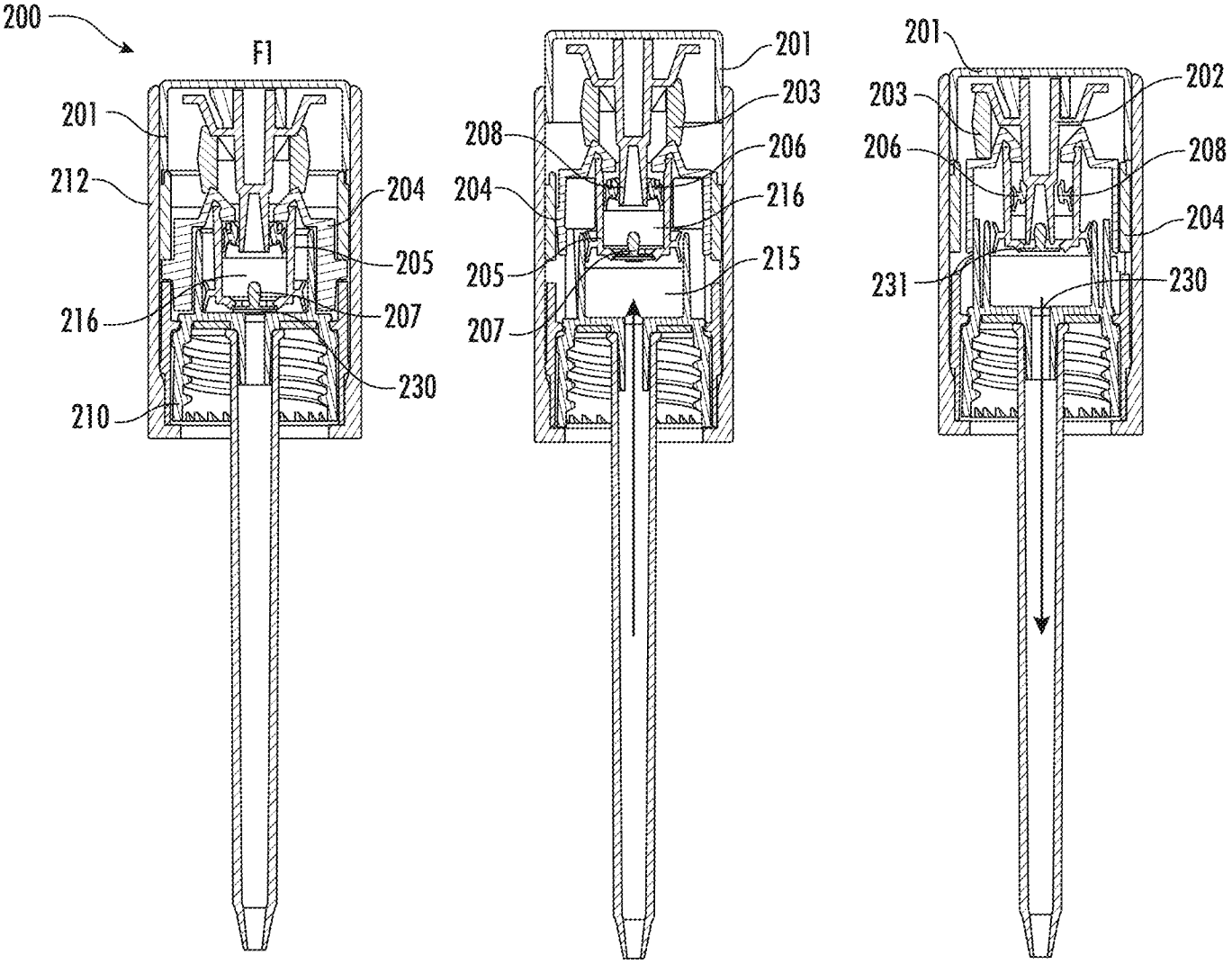

The operation of the dispensing assembly 200 according to the present invention will be described below in detail in conjunction with FIGS. Sa to 5*c*. FIG. 5*a* shows the dispensing assembly in a storage state; FIG. 5*b* shows the dispensing assembly in a dispensing state; and FIG. 5*c* shows the dispensing assembly when one dispense is performed. Referring to FIG. 5*a*, the cam seat 204 is in the lower position; the primary piston 205 is in the lower position in the first chamber 215; and the first valve 207 simultaneously seals the first opening 230 and the second opening 231 (as shown in FIG. 8*b*). At this time, the top cover 201 is in the rest position, and the piston rod 202 with the secondary piston 206 is in the top position in the second chamber 216.

When the user rotates the shroud 212 in the first direction F1, the closure 210 is disengaged with the container. At the same time, the shroud 212 causes the rotary ring 209 to rotate in the first direction, and the rotary ring 209 actuates the cam seat 204 to move from the lower position to the upper position. The cam seat 204 in turn causes the primary piston 205 and the first valve 207 held on it to move upward vertically, whereby the first valve 207 leaves the first opening 230. At this time, since the primary piston 205 moves upward in the first chamber, a negative pressure is generated in the first chamber, and the first fluid in the container is automatically sucked into the first chamber as indicated by the arrow. Further, due to the actuation of the cam seat 204, the piston rod 202, the secondary piston 206, the elastic element 203 and the top cover 201 also move upward vertically with the cam seat 204, whereby the top cover 201 enters the depressible position. The piston rod 202 and the secondary piston 206 still remain in the top position in the second chamber. As shown in FIG. 5*b*, when the cam seat 204 reaches the upper position, the primary piston 205 reaches the top of the first chamber, and the top cover 201 reaches the depressible position. At this time, the dispensing assembly 200 enters into the dispensing state. The second valve 208 is in an open state, allowing the second fluid (e.g., ambient air) to enter the second chamber 216.

Referring to FIG. 5*c*, when the user depresses the top cover 201, the top cover 201 actuates the piston rod 202 to move downward. The piston rod 202 in turn compresses and deforms the elastic element 203. The elastic element 203 may move outward radially along the upper guiding surface 221 and the lower guiding surface 222. When subjected to a downward compression force, the elastic element 203 may also expand. The lower end of the piston rod 202 actuates the secondary piston 206 to move downward, causing the second valve 208 to be closed. After the second valve 208 is closed, further downward movement of the piston rod 202 and the secondary piston 206 compresses the second fluid in the second chamber, and the pressure generated in the second chamber is applied to the first valve 207, causing the first valve 207 to move slightly downward and leave the second opening 231, while at least a portion of the first valve still remains in the second chamber. The second opening 231 allows for the fluid communication between the first chamber 215 and the second chamber 216, and the second fluid in the second chamber enters the first chamber 215 through the second opening 231. The second fluid that enters the first chamber forces a portion of the first fluid to be discharged through the pipette 213. When the piston rod 202 and the secondary piston 206 reach the bottom position in the second chamber, the second fluid of substantially the second volume V2 enters the first chamber, and the first fluid of a volume corresponding to the second volume V2 is discharged from the first chamber.

When the user releases the top cover, due to the restoring force of the elastic element 203, the piston rod 202 and the secondary piston return to the position at the top of the second chamber, and the second valve reopens. The top cover 201 also returns to the depressible position and is ready to be depressed again for the next dispense. At this time, the dispensing assembly 200 in FIG. 5*c* returns to its dispensing state as shown in FIG. 5*b*. The user may move the dispensing assembly 200 to any desired location, and depress the top cover again, so as to dispense the first fluid of substantially the second volume V2 again. The above operation can be repeated until the first fluid of the first volume V1 in the first chamber is completely discharged out.

When the first fluid in the first chamber is completely discharged out, the user may insert the pipette back into the container, and rotate the shroud in a second direction opposite to the first direction, such that the dispensing assembly 200 returns to its storage state as shown in FIG. 5*a*, and the closure is re-engaged with the container.

The first volume V1 may be n times the second volume V, wherein n is an integer. Thus, the dispensing assembly is configured to allow dispensing the first fluid of the first volume V1 by n depressions of the user, wherein each depression allows for dispensing the first fluid of a volume corresponding to the second volume V2. In an embodiment, V1 may be 0.8 mL, and V2 may be 0.2 mL. When the container is opened, the first fluid of 0.8 mL is automatically drawn into the first chamber, and simultaneously the top cover enters the depressible position. At this point, the user may move the dispensing assembly to the desired location and precisely dispense 0.2 mL of the product by depressing the top cover once. At this point, if needed, the user may move the dispensing assembly again to another desired location and depress again to dispense another 0.2 mL of the product. The user can repeat the dispensing 4 times without having to draw the product from the container. The above numerical values are for illustrative purposes only, and any suitable dimension may be provided for the dispensing assembly according to the present invention as needed. Thus, the dispensing assembly and the container system according to the present invention allow the user to dispense the product more flexibly and more accurately, and its operation is simpler. In other embodiments, the first volume V1 may also be provided to be greater than n times the second volume V2, where n is an integer.

Figure 6A:
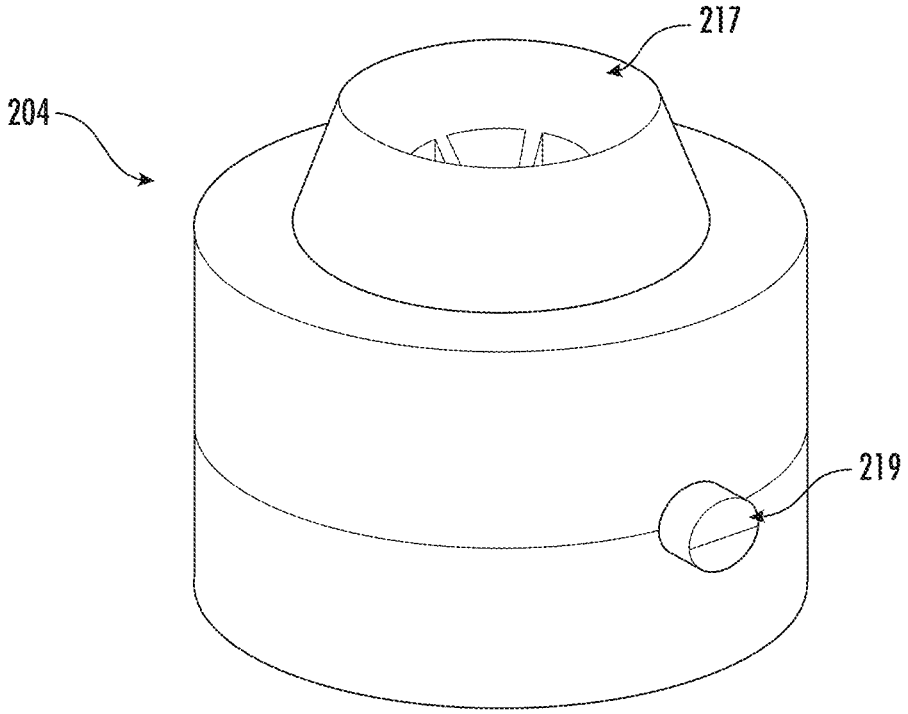
FIG. 6*a* and FIG. 6*b* schematically show a cam seat according to an embodiment of the present invention.
Figure 6B:
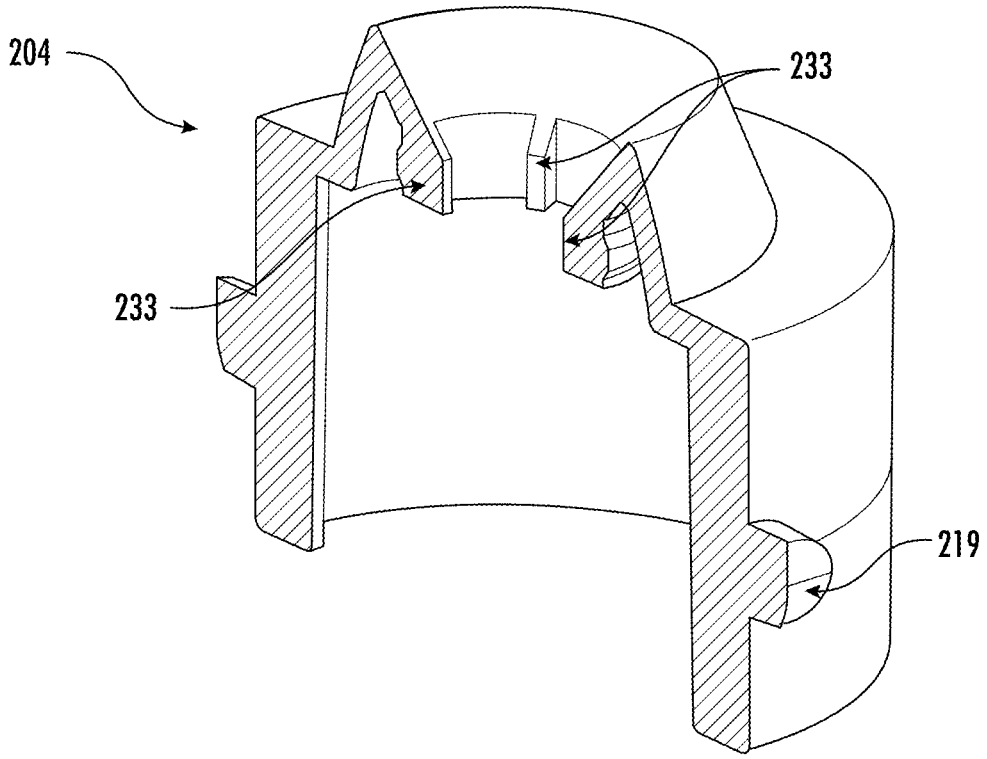
Figure 10A:
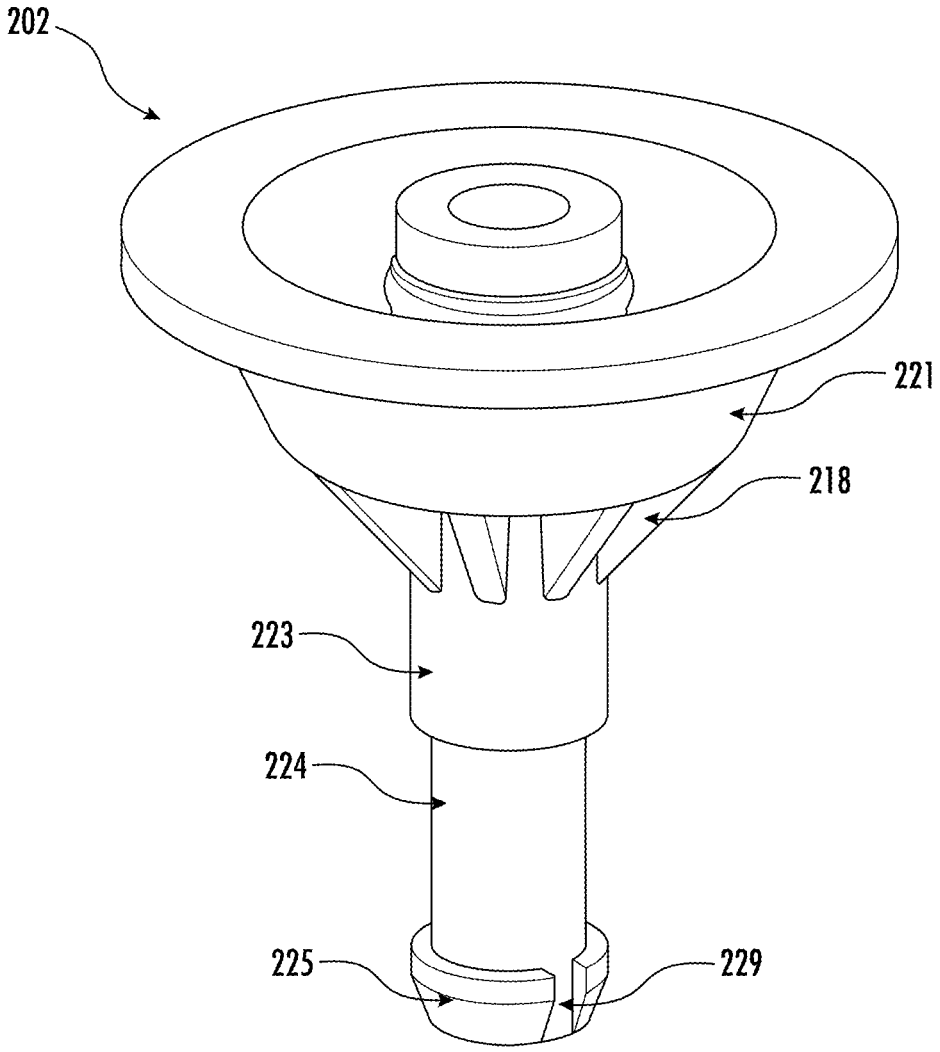
FIG. 10*a* and FIG. 10*b* schematically show a piston rod according to an embodiment of the present invention.
Figure 10B:
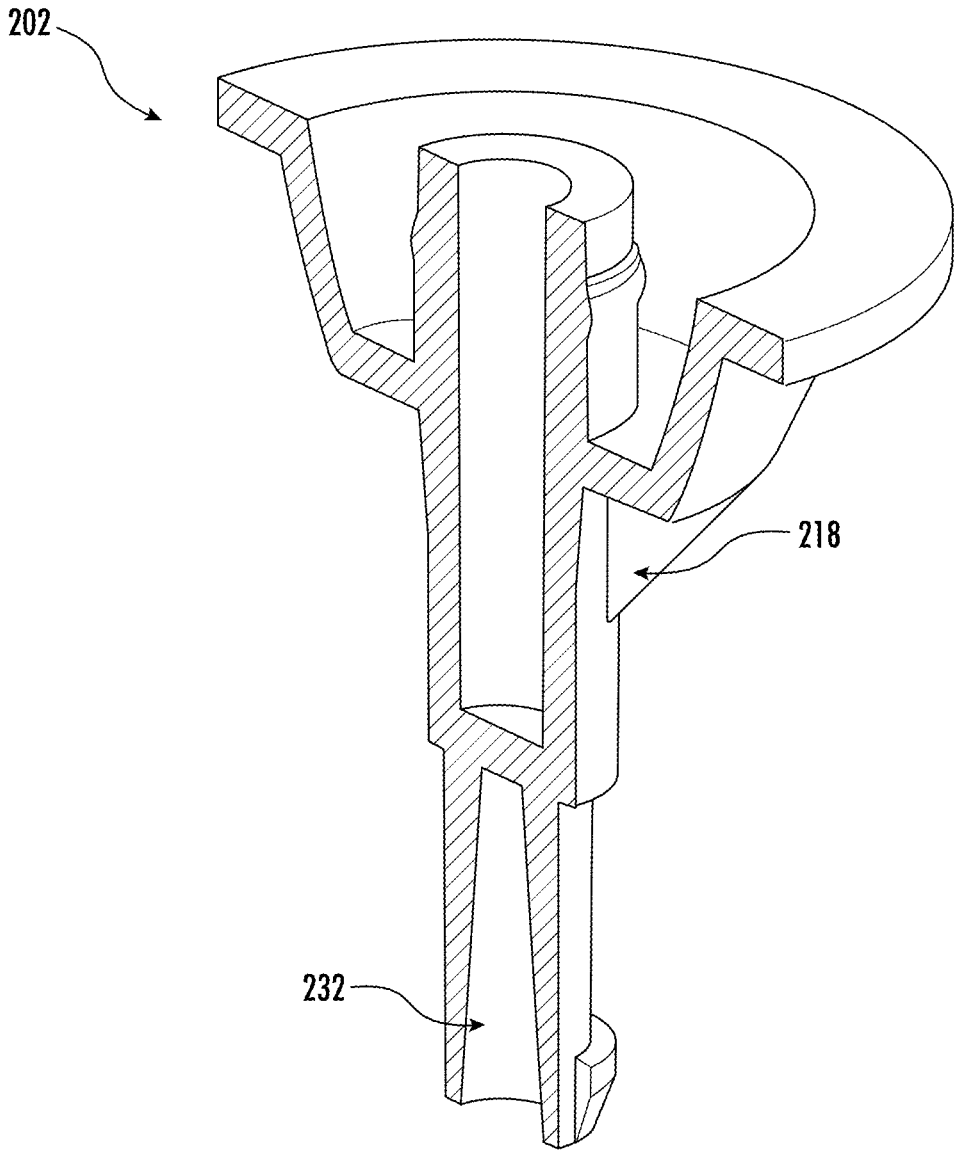

FIG. 6*a* schematically shows a cam seat 204 according to an embodiment of the present invention, and FIG. 6*b* schematically shows a cross-sectional view of the cam seat 204. In a preferred embodiment, the cam seat 204 may also include a first inclined mating surface 217 on the inner side of the upper end to facilitate the assembly of the dispensing assembly, and the first inclined mating surface 217 may accommodate a second mating surface 218 of the piston rod in use (as shown in FIGS. 10*a* and 10*b*), to help guide the stroke of the piston rod and reduce the force required for depressing the top cover.

In another preferred embodiment, as shown in FIG. 6*b*, below the first mating surface 217, the cam seat 204 may also include a radially inwardly extending rib 233 on the inner side of the upper end, preferably a plurality of evenly spaced-apart ribs. The rib 233 may be adjacent to the outer side of the piston rod, and the space between the respective ribs allows the second fluid to enter the second chamber.

Figure 7:
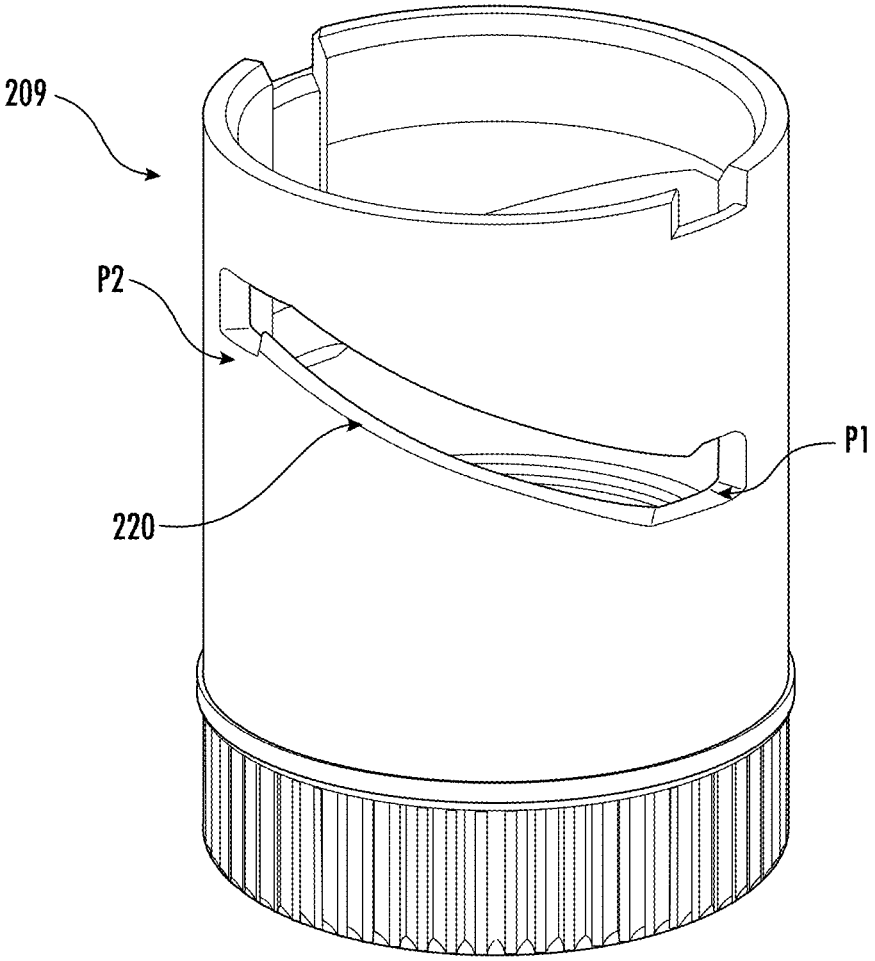
FIG. 7 is a schematic view of a rotary ring according to an embodiment of the present invention.

As shown in FIGS. 6*a* and 6*b*, the cam seat 204 comprises at least one protrusion 219 on the outer side, preferably two protrusions. Preferably, the two protrusions are symmetrically provided. As shown in FIG. 7, the rotary ring mating with the cam seat 204 correspondingly comprises at least one guide track 220 for guiding the protrusion 219, preferably two guide tracks. Preferably, the two guide tracks are symmetrically provided for guiding the protrusions 219 respectively. The guide track 220 comprises a first horizontal section, an inclined section and a second horizontal section, wherein the first horizontal section defines a first horizontal position P1 of the protrusion 219, and the second horizontal section defines a second horizontal position P2 of this protrusion. Other embodiments of the protrusion 219 and the guide track 220 not shown in the figures are also feasible, provided that the rotational motion of the shroud can be converted into a linear motion of the piston rod.

By rotating the shroud 212 and the rotary ring 209, the protrusion(s) 219 is movable between the first horizontal position P1 and the second horizontal position P2 in the guide track 220. When the top cover is in the rest position, the protrusion(s) 219 is in the first horizontal position P1 in the guide track 220, and when the top cover is in the depressible position, the protrusion(s) 219 is in the second horizontal position P2 in the guide track 220.

In the embodiment shown in FIG. 7, the first horizontal position P1 is lower than the second horizontal position P2. When the shroud 212 and the rotary ring 209 are rotated in the first direction F1 corresponding to the opening, the protrusion(s) 219 may slide from the first horizontal position to the second horizontal position. At this time, the cam seat 204 moves up from the lower position and actuates the top cover 201, the piston rod 202, the elastic element 203, the primary piston 205, the secondary piston 206 and the first valve 207 to move upward. Conversely, when the shroud 212 and the rotary ring 209 are rotated in the second direction F2 corresponding to the closing, the protrusion(s)

219 returns to the first horizontal position, and the cam seat returns to the lower position and other components all return to their initial positions.

In other embodiments not shown, the rotary ring 209 may include at least one protrusion, preferably two protrusions. Preferably, the two protrusions are symmetrically provided. Accordingly, the cam seat 204 includes at least one guide track on the outer side for guiding the protrusion(s), preferably two guide tracks. Preferably, the two guide tracks are symmetrically provided for guiding the protrusions respectively. In this embodiment, the first horizontal position where the protrusion is initially located is higher than the second horizontal position, so that when the shroud and the rotary ring are rotated in the first direction, the protrusion moves from the first horizontal position to the second horizontal position. At the same time, the cam seat 204 moves up from the initial position and actuates the top cover 201, the piston rod 202, the elastic element 203, the primary piston 205, the secondary piston 206 and the first valve 207 to move upward. When the shroud 212 and the rotary ring 209 are rotated in the second direction corresponding to the closing, the protrusion(s) returns to the first horizontal position, and the cam seat returns to the lower position and other components all return to their initial positions.

Figure 8A:
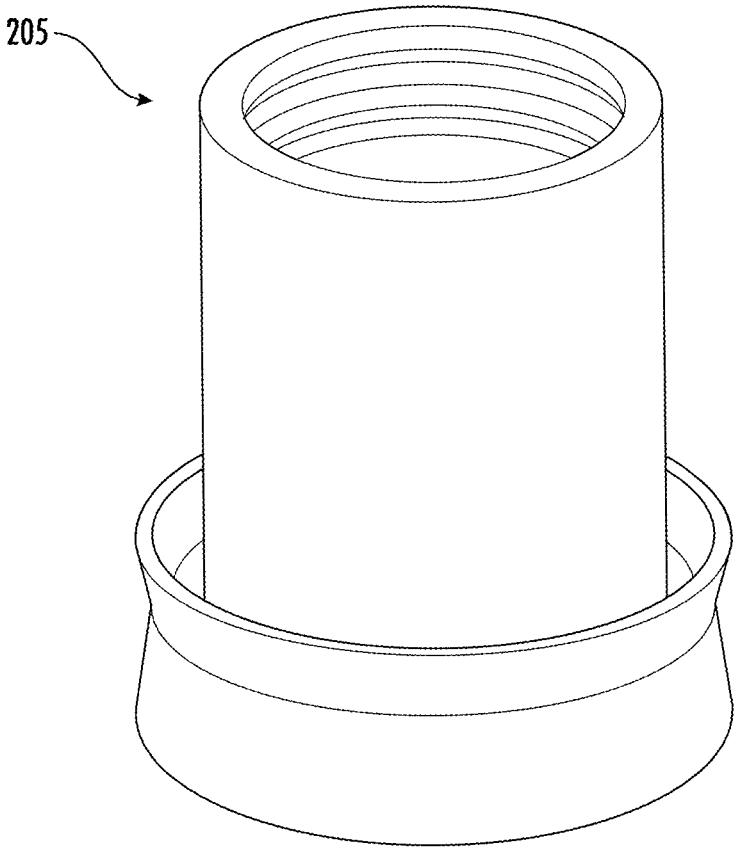
FIG. 8*a* and FIG. 8*b* schematically show a primary piston according to an embodiment of the present invention.
Figure 8B:
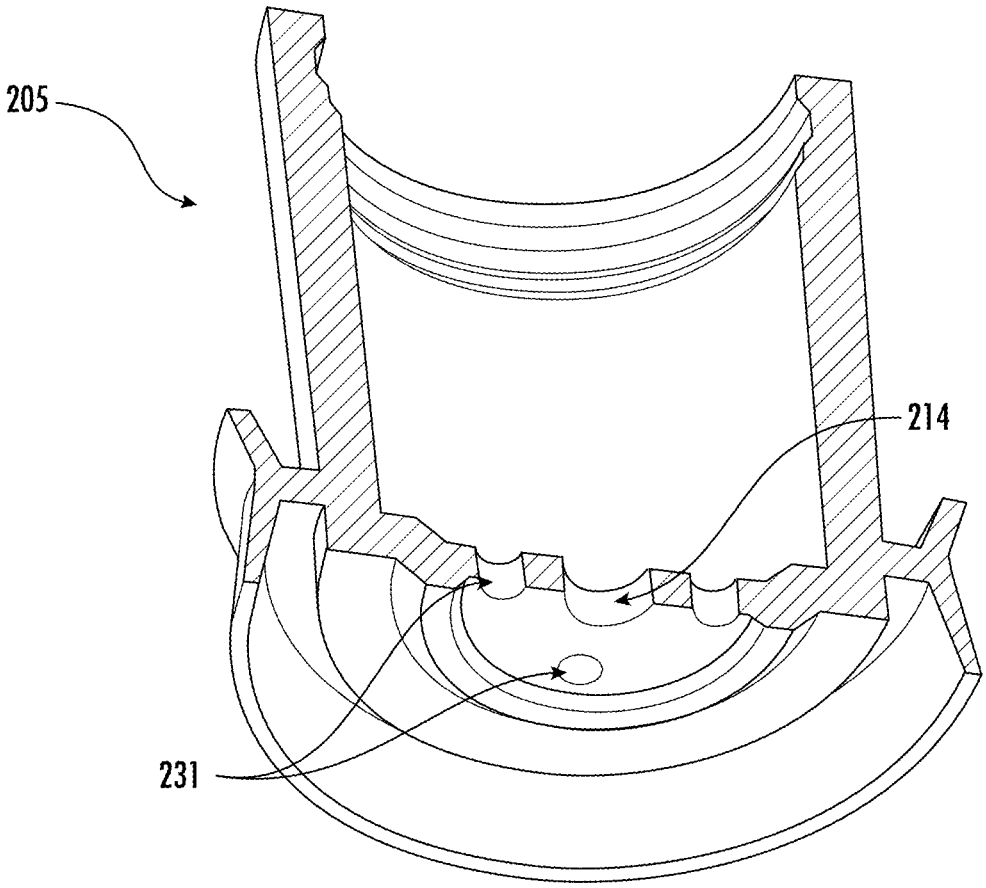

FIG. 8*a* schematically illustrates a primary piston 205 according to an embodiment of the present invention, and FIG. 8*b* schematically shows a bottom sectional view of the primary piston 205. The primary piston 205 has an outer portion which is slidable along the sidewall of the first chamber and a substantially cylindrical inner portion. The outer portion and the inner portion are connected at the lower end by an intermediate portion. As shown in FIG. 8*b*, the primary piston 205 is provided at the bottom with a valve-passing-opening 214 which allows at least a portion of the first valve to be inserted and held therein. The upper portion of the first valve 207 is inserted into the valve-passing-opening 214 and may be held therein, so that the first valve can move with the primary piston. The first valve 207 is not fixed in the valve-passing-opening, but being able to move slightly in this valve-passing-opening 214 without disengaging therefrom. The primary piston 205 further includes a second opening at the bottom, which may be in the form of a through-hole. The second opening may be at least one through-hole, preferably a plurality of through-holes evenly distributed at the bottom. When the first valve 207 moves down under the pressure of the second fluid and leaves the second opening 231, the second fluid can enter the second chamber through the second opening 231.

Figure 9A:
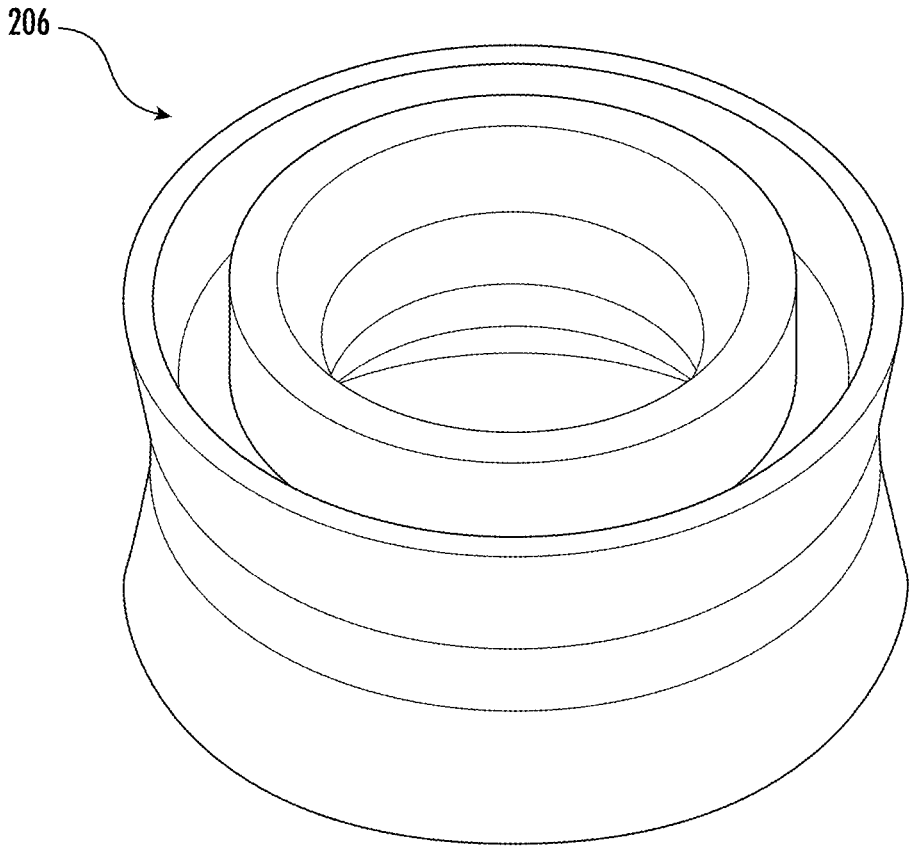
FIG. 9*a* and FIG. 9*b* schematically show a secondary piston according to an embodiment of the present invention.
Figure 9B:
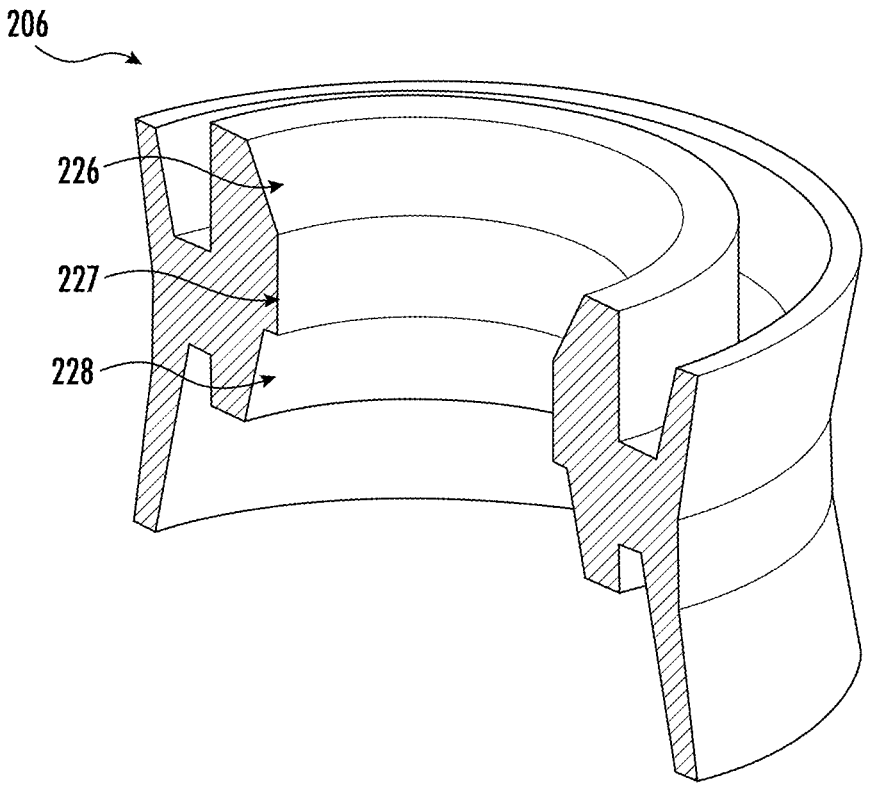

FIG. 9*a* schematically shows a secondary piston 206 according to an embodiment of the present invention, and FIG. 9*b* schematically shows a section of the secondary piston 206. The secondary piston 206 comprises an outer portion which is slidable along the sidewall of the second chamber and an inner portion. The outer portion and the inner portion may be connected by an intermediate portion. As shown in FIG. 9*b*, the secondary piston includes in the inner portion an upward expanding section 226, a downward expanding section 228, and an intermediate section 227 connecting the upward expanding section and the downward expanding section. The inner side of the secondary piston 206 is such provided that it can cooperate with the lower end of the piston rod to form a second valve.

FIG. 10*a* schematically shows a piston rod 202 according to an embodiment of the present invention, and FIG. 10*b* schematically shows a section of this piston rod. The piston rod 202 comprises an upper guiding surface 221 for guiding the elastic element 203. In a preferred embodiment, below the upper guiding surface, the piston rod 202 may include a second mating surface 218 that can match with the first mating surface 217 of the cam seat, so as to facilitate the assembly of the dispensing assembly, to help guide the stroke of the piston rod in use, and to reduce the force required for depressing the top cover.

Below the second mating surface 218, the piston rod may further include a first diameter segment 223 and a second diameter segment 224. The diameter of the second diameter segment 224 is less than that of the first diameter segment 223. The first diameter segment 223 extends around the entire perimeter of the piston rod. The second diameter segment 224 of the piston rod 202 may pass through the channel defined in the middle of the secondary piston 206, while the first diameter segment cannot pass through it. At the lower end of the second diameter segment 224, there is also a lower flange 225 which extends around a portion of the perimeter of the piston rod, and sets aside an axial channel 229 allowing the second fluid to pass through. In some embodiments, the outer diameter of the first diameter segment 223 may be greater than the minimum inner diameter of the upward expanding section 226. The outer diameter of the second diameter segment 224 may be slightly smaller than the inner diameter of the intermediate section 227. The maximum outer diameter of the lower flange 225 may be greater than the minimum inner diameter of the downward expanding section 228. In a preferred embodiment, as shown in FIG. 10*b*, the piston rod 202 may further include a recess 232, which may be used to accommodate the upper portion of the first valve 207 when the piston rod moves to the bottom position in the second chamber, thereby saving the internal space of the dispensing assembly and improving the compactness of the dispensing assembly.

Figure 11B:
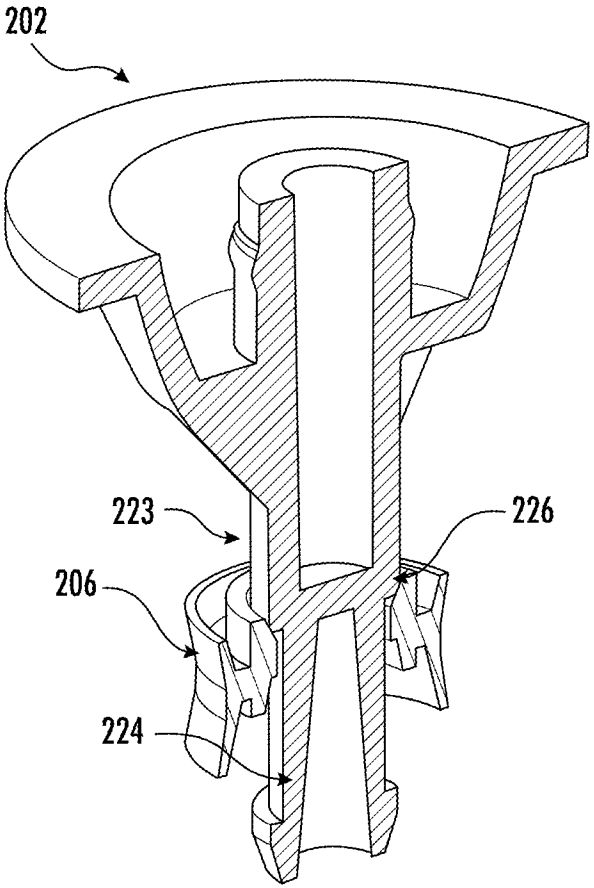
FIG. 11*a* and FIG. 11*b* schematically show a piston rod cooperating with a driven piston according to an embodiment of the present invention.
Figure 11A:
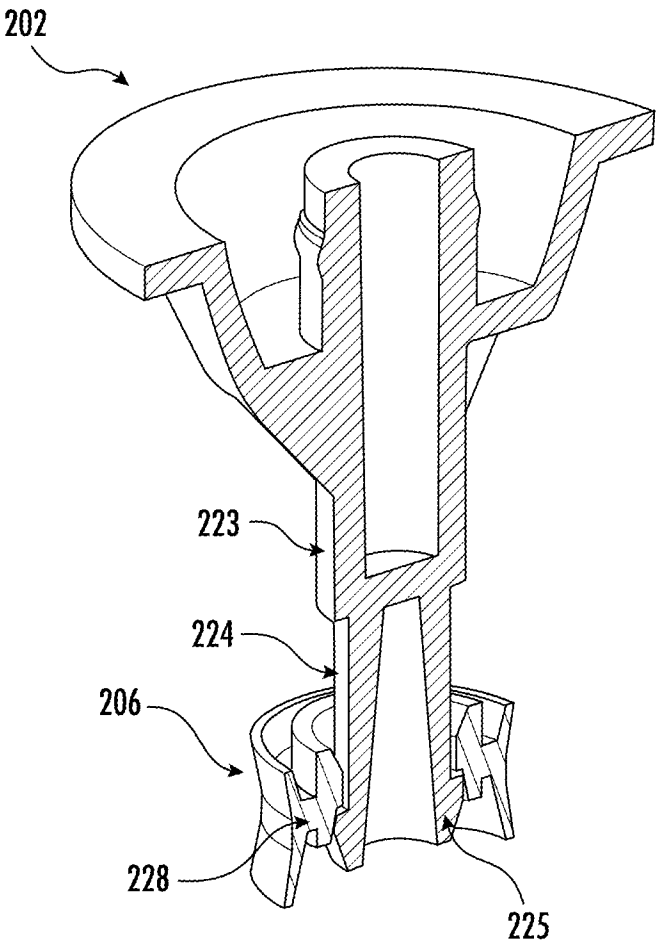

FIGS. 11*a* and 11*b* show the open and closed state of the second valve 208 respectively. As shown in FIG. 11*a*, when the lower flange 225 of the piston rod 202 abuts against the downward expanding section 227 of the secondary piston 206, the second valve is in an open state, and the second fluid may enter the second chamber through the axial channel 229. When the piston rod 202 and the secondary piston 206 are in the top position in the second chamber, the second valve is in an open state.

When the top cover 201 is depressed and the piston rod 202 is actuated to move downward, the piston rod 202 first travels through the channel in the middle of the secondary piston, until its first diameter segment 223 is stopped by the upward expanding section 226 of the secondary piston 206. As shown in FIG. 11*b*, when the first diameter segment 223 of the piston rod 202 reaches to abut against the upward expanding section 226 of the secondary piston 206, the second valve is closed to prevent the second fluid from entering the second chamber. The piston rod then moves with the secondary piston to the bottom position in the second chamber. When the top cover 201 is released, the piston rod moves up and returns through the channel in the middle of the secondary piston, until the lower flange 225 abuts against the downward expanding section 228, whereby the second valve 208 is open again. The secondary piston then returns to the top position in the second chamber together with the piston rod.

Figure 12:
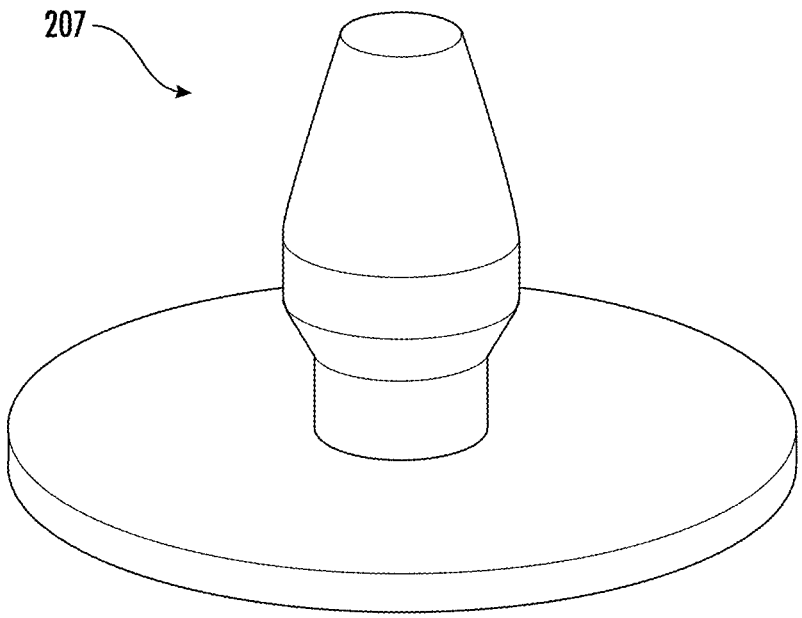
FIG. 12 is a schematic view of a first valve according to an embodiment of the present invention.

FIG. 12 schematically illustrates a first valve 207 according to an embodiment of the present invention. The first valve may be a disc valve. The disc valve may include a disc and an extension protruding from the disc which may have a reduced-diameter portion to allow it to extend through the valve-passing-opening in the primary piston.

Figure 13:
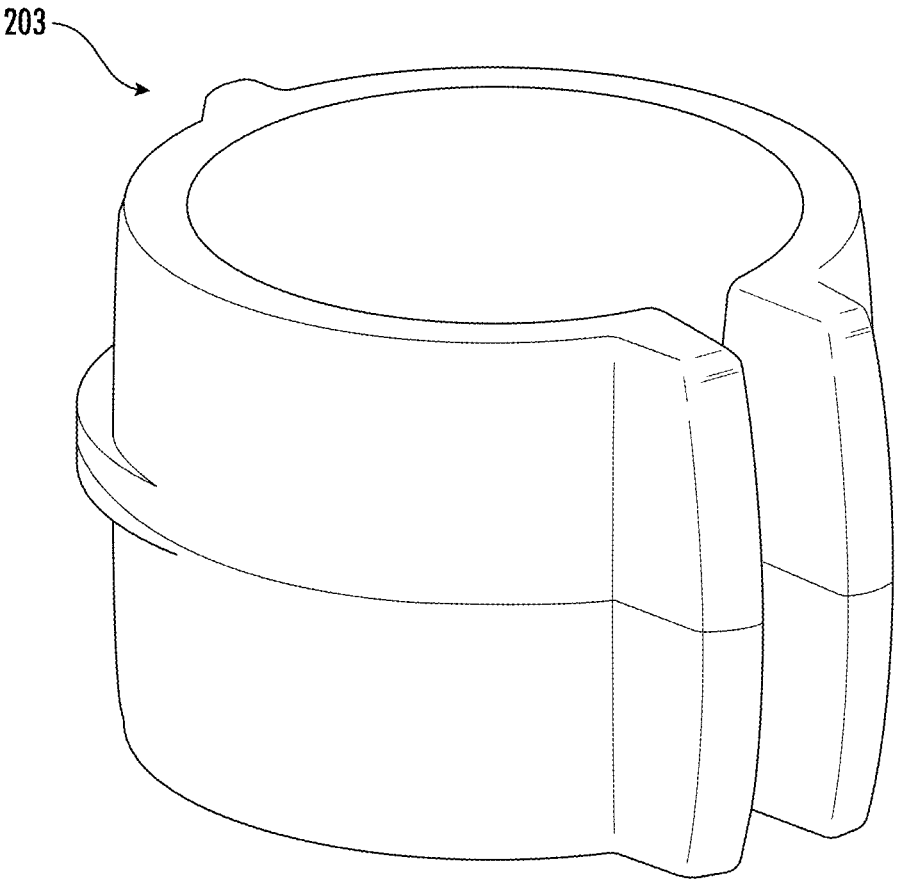
FIG. 13 is a schematic view of an elastic element according to an embodiment of the present invention.

FIG. 13 schematically illustrates an elastic element 203 according to an embodiment of the present invention. The elastic element 203 may be substantially annular or C-shaped. The annular or C-shaped elastic element 203 may deform when subjected to a force in the vertical direction, such that its diameter changes to allow the piston rod to further move downward and actuate the secondary piston. The elastic element 203 may be made of an elastic material or a plastic material. Furthermore, as compared to metal materials used in the prior art, a deformable element made of a plastic material can facilitate the recycling of the entire container system. In another embodiment, the elastic element may include a partially-weakened area such that its diameter changes when subjected to a force. In an embodiment, the elastic element may laterally include two legs, such that when the top cover is depressed, the two legs are forced to expand, and when the top cover is released, the two legs return to the initial position. In a preferred embodiment, the elastic element may include a stiffener at the portion connecting the two legs or the middle portion of the C-shaped elastic element, to extend the service life of the elastic element. For the elastic element, any embodiment that deforms when the piston rod moves downward and returns to its initial position when the top cover is released is feasible.

Figure 14A:
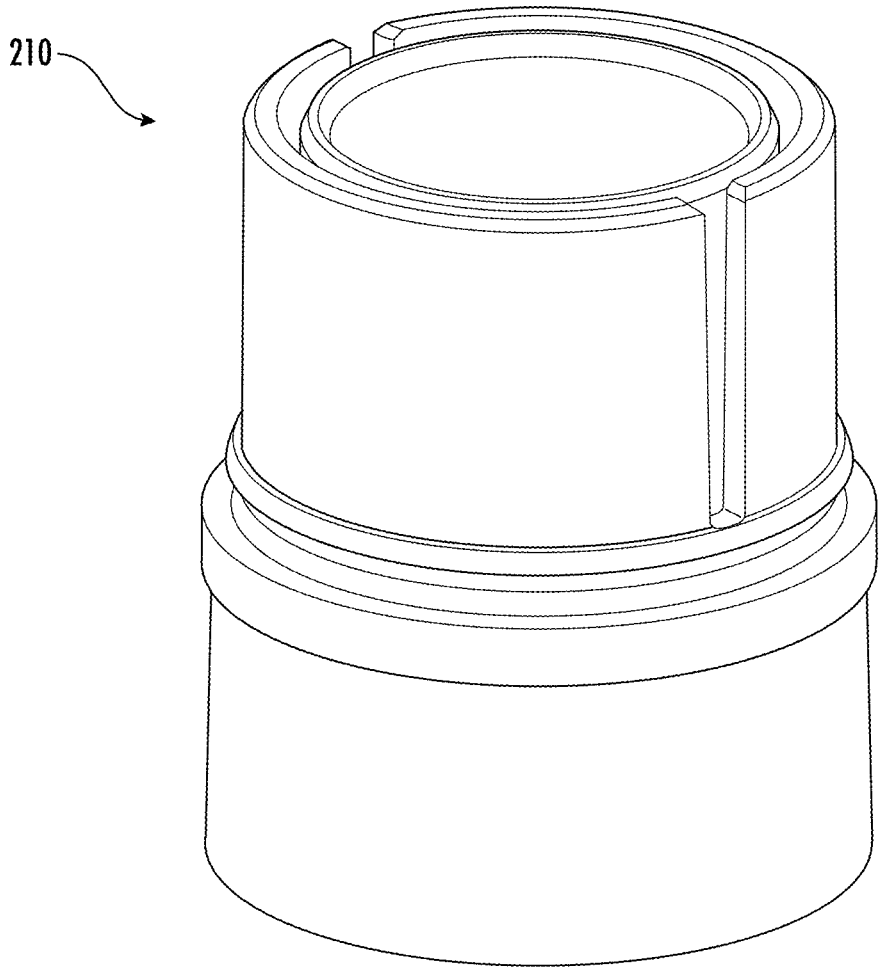
FIG. 14*a* and FIG. 14*b* schematically show a closure according to an embodiment of the present invention.
Figure 14B:
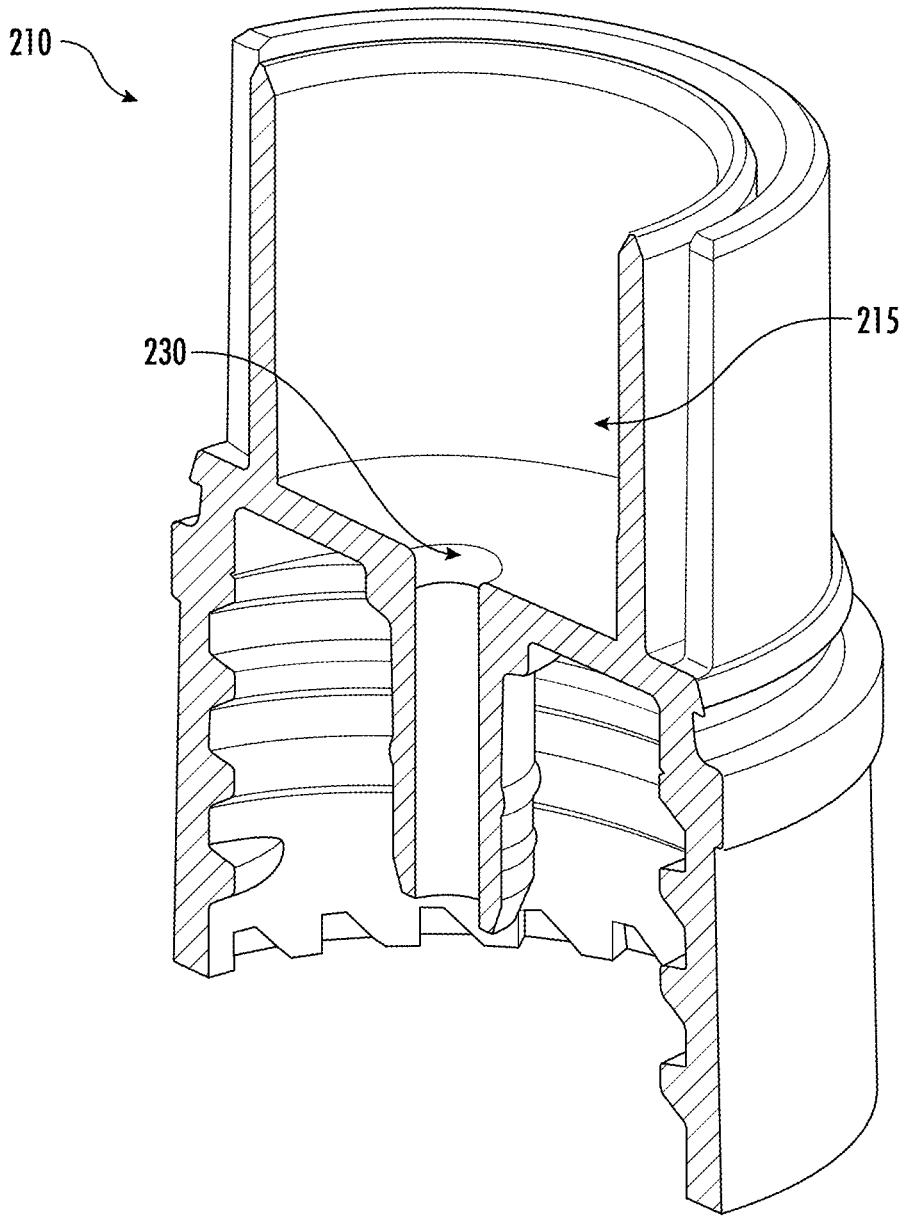

FIGS. 14*a*-14*b* schematically illustrates a closure 210 according to an embodiment of the present invention. The closure is generally cylindrical, with its upper portion being located inside the cam seat and its lower portion being provided for engagement with the container. In an embodiment, the closure 210 may include an internal thread(s) to sealingly engage with an external thread(s) at the top of the container, or vice versa. As shown in FIG. 14*b*, the closure defines a first opening 230 at the bottom, and defines internally a first chamber 215. A tubular extension may be provided at the lower end of the first opening, and the pipette 213 may be securely connected to the outside of the tubular extension.

Although it is shown in the figures that the counterclockwise direction corresponds to the opening, the direction is not limited to the counterclockwise direction. Various directions in the embodiments of the present application may be changed as needed without departing from the scope of the present application. Although the present invention has been described in detail with reference to preferred embodiments, it will be understood that the present invention is not limited by the disclosed examples, and those skilled in the art are able to make many other modifications and variations based on them without departing from the scope of the present invention. It should be noted that the use of "a" throughout this application does not exclude a plural number, and "comprise" or "include" does not exclude other components. In addition, components described in connection with various embodiments may be combined.

LIST OF REFERENCE SIGNS

100 Container system
200 Dispensing assembly
300 Container
400 First fluid
500 Second fluid
201 Top cover
202 Piston rod
203 Elastic element
204 Cam seat
205 Primary piston
206 Secondary piston
207 First valve
208 Second valve
209 Rotary ring
210 Closure
211 Gasket
212 Shroud
213 Pipette
214 Valve-passing-opening
215 First chamber
216 Second chamber
217 First mating surface
218 Second mating surface
219 Protrusion
220 Guide track
221 Upper guiding surface
222 Lower guiding surface
223 First diameter segment
224 Second diameter segment
225 Lower flange
226 Upward expanding section
227 Intermediate section
228 Downward expanding section
229 Axial channel
230 First opening
231 Second opening
232 Recess
233 Rib
V1 First volume
V2 Second volume
F1 First direction
P1 First horizontal position
P2 Second horizontal position

What is claimed is:

1. A dispensing assembly for dispensing a first fluid, comprising:

a first chamber comprising:
- a first volume;
- a bottom with a first opening; and
- a first valve sealing the first opening, wherein when the first valve leaves the first opening, the first fluid is allowed to enter or leave the first chamber;

a second chamber comprising:
- a second volume less than the first volume;
- a second opening sealed by the first valve, wherein when the first valve leaves the second opening, the first chamber is in fluid communication with the second chamber; and
- a second valve, wherein when the second valve is open, a second fluid can enter the second chamber;

a primary piston slidable along a sidewall of the first chamber wherein the second chamber is defined by an internal portion of the primary piston;

a secondary piston located in the second chamber and slidable along a sidewall of the second chamber;

a movable piston rod, comprising a lower end is located in the second chamber, the movable piston rod configured to actuate the secondary piston to slide along the sidewall of the second chamber;

wherein when the first valve leaves the first opening, the second valve is closed as the piston rod actuates the secondary piston to slide downward, and the pressure of the second fluid in the second chamber forces the first valve to leave the second opening so that the second fluid in the second chamber enters the first chamber, thereby allowing the first fluid of a volume corresponding to the second volume to be dispensed out from the first chamber.

2. The dispensing assembly according to claim 1, wherein the dispensing assembly further comprises:

a movable cam seat engaged with an upper end of the primary piston, the cam seat movable between an upper position and a lower position, a rotary ring located outside the cam seat, which actuates the cam seat when being rotated, a shroud located outside the rotary ring, which fits closely with the rotary ring so as to actuate the rotary ring to rotate with it when being rotated, wherein rotation of the shroud in a first direction with the rotary ring causes the cam seat to move towards the upper position, and at the same time causes the primary piston to slide upwards along the sidewall of the first chamber, such that the first valve engaged with the primary piston leaves the first opening, allowing the first fluid of the first volume to enter the first chamber through the first opening; and wherein rotation of the shroud in a second direction opposite to the first direction, the cam seat, the primary piston and the first valve return downward to their lower positions, and the dispensing assembly returns to a storage state.

3. The dispensing assembly according to claim 2, wherein the cam seat comprises at least one protrusion on the outer side, and the rotary ring comprises at least one guide track for guiding the at least one protrusion, wherein when the cam seat is located in the lower position, the at least one protrusion is in a first horizontal position in the guide track; when the cam seat is in the upper position, the at least one protrusion is in a second horizontal position in the guide track, and the height of the first horizontal position is different from the height of the second horizontal position.

4. The dispensing assembly according to claim 2, wherein the dispensing assembly further comprises an elastic element supported between the piston rod and the cam seat, wherein the piston rod comprises an inclined upper guiding surface at its upper end for guiding an upper end of the elastic element, and the cam seat comprises an inclined lower guiding surface at its upper end for guiding a lower end of the elastic element.

5. The dispensing assembly according to claim 4, wherein the dispensing assembly further comprises:

a top cover having a rest position and a depressible position, the top cover-which is-closely engaged with a top end of the piston rod;

wherein depression of the top cover in the depressible position actuates the piston rod, causing the elastic element to deform, the first valve is forced to leave the second opening, and to dispense a first fluid of the second volume from the dispensing assembly; and wherein release of the top cover, due to allows a restoring force provided by the elastic element to return the piston rod and the secondary piston to their top position in the second chamber, and the top cover returns to the depressible position.

6. The dispensing assembly according to claim 2, wherein:

the cam seat further comprises a first inclined mating surface on an inner side of the upper end; and the piston rod comprises a second mating surface on the outer side, wherein the first inclined mating surface and the second mating surface cooperate to guide the movement of the piston rod.

7. The dispensing assembly of claim 1, wherein the secondary piston comprises:

an upward expanding section on the inner side; and a downward expanding section;

wherein the movable piston rod comprises:

a first diameter segment;

a second diameter segment; and a lower flange on a lower end of the second diameter segment, the lower flange extending around a portion of the perimeter of the movable piston rod and adjacent an axial channel;

wherein when the downward expanding section of the secondary piston abuts against the lower flange of the movable piston rod, the second valve opens, and the second fluid enters the second chamber through the axial channel; and when the upward expanding section of the secondary piston abuts against the first diameter segment of the movable piston rod, the second valve is closed to prevent the second fluid from entering the second chamber.

8. The dispensing assembly according to claim 7, wherein the secondary piston further comprises an intermediate section connecting the upward expanding section with the downward expanding section, and wherein an outer diameter of the first diameter segment is greater than a minimum inner diameter of the upward expanding section, an outer diameter of the second diameter segment is slightly less than an inner diameter of the intermediate section, and a maximum outer diameter of the lower flange is greater than a minimum inner diameter of the downward expanding section.

9. The dispensing assembly according to claim 1, wherein the first volume is n times the second volume, wherein n is an integer, the dispensing assembly is configured to allow dispensing the first fluid of the first volume by n presses, wherein each press allows dispensing the first fluid of a volume corresponding to the second volume.

10. The dispensing assembly according to claim 1, wherein the primary piston comprises a valve-passing-opening for allowing at least a portion of the first valve to be inserted and held therein, and the first valve is able to move slightly in the valve-passing-opening without leaving the primary piston; and wherein the second opening is at least one through-hole provided at the bottom of the primary piston.

11. The dispensing assembly according to claim 7, wherein the movable piston rod comprises a recess inside the second diameter segment, which allows to accommodate at least a portion of the first valve.

12. The dispensing assembly according to claim 1, further comprising a closure which defines internally the first chamber and the first opening at its bottom.

13. The dispensing assembly according to claim 1, wherein the first fluid is a product to be dispensed, and the second fluid is air.

14. The dispensing assembly according to claim 12, wherein the dispensing assembly further comprises:

a gasket on the closure; and a pipette connected to the closure, the pipette being in fluid commutation with the first opening.

15. A container system comprising:

the dispensing assembly according to claim 14; and a container which defines a storage chamber for containing the first fluid and to which the dispensing assembly is removably connected, the pipette of the dispensing assembly extending into the container.

16. A container system, comprising:
a container;
a first fluid contained in the container;
a dispensing assembly, comprising:
a closure attached to the container, comprising:
a first chamber having a bottom; and
a first opening in the bottom of the first chamber;
a primary piston seated in the first chamber, comprising:
a second chamber on an interior of the primary piston;
a second opening in the bottom of the second chamber; and
a top end;
a first valve seated in the primary piston adjacent the second opening;
a cam seat engaged with the top end of the primary piston;
a secondary piston seated in the second chamber;
a piston rod moveably seated in the secondary piston, wherein the engagement of the piston rod with the secondary piston forms a second valve;
a top cover connected to the piston rod;
a rotary ring in communication with the cam seat; and
a shroud connected to the rotary ring; and
a pipette attached to the closure and in fluid communication with the first fluid at one end and the first chamber at an opposite end.

17. The container system of claim 16, further comprising:
an inclined upper guiding surface on the piston rod;
an inclined lower guiding surface on the cam seat; and
an elastic element seated against the inclined upper guiding surface and the lower guiding surface.

* * * * *